United States Patent [19]

Pollack

[11] Patent Number: 4,802,431

[45] Date of Patent: Feb. 7, 1989

[54] LIGHTWEIGHT TRANSFER REFERENCING AND MOORING SYSTEM

[75] Inventor: Jack Pollack, Reseda, Calif.

[73] Assignee: Amtel, Inc., Providence, R.I.

[21] Appl. No.: 43,174

[22] Filed: Apr. 27, 1987

Related U.S. Application Data

[63] Continuation-in-part of Ser. No. 802,860, Nov. 27, 1985, Pat. No. 4,727,819, which is a continuation-in-part of Ser. No. 603,434, Apr. 24, 1984, Pat. No. 4,637,335, which is a continuation-in-part of Ser. No. 438,322, Nov. 1, 1982, abandoned.

[51] Int. Cl.[4] ..... B63B 21/00

[52] U.S. Cl. ..... 114/230; 114/293

[58] Field of Search ..... 166/352, 353, 354, 355; 175/7; 114/230, 144 B, 293; 405/224; 441/3-5

[56] References Cited

U.S. PATENT DOCUMENTS

| | | | |
|---|---|---|---|
| 3,407,416 | 10/1968 | Brickhouse | 441/5 |
| 3,543,526 | 12/1970 | O'Neill | 61/69 |
| 3,602,174 | 8/1971 | Gorman | 441/4 |
| 3,834,432 | 9/1974 | Lilly, Jr. et al. | 114/230 |
| 3,979,785 | 9/1976 | Flory | 114/230 |
| 4,153,112 | 5/1979 | Luke | 166/355 |
| 4,205,379 | 5/1980 | Fox et al. | 114/144 B |
| 4,281,614 | 8/1981 | McNary et al. | 175/7 |
| 4,301,760 | 11/1981 | Cassone et al. | 166/354 |
| 4,448,266 | 5/1984 | Potts | 175/7 |
| 4,490,121 | 12/1984 | Coppens et al. | 114/230 |

*Primary Examiner*—Joseph F. Peters, Jr.
*Assistant Examiner*—Edwin L. Swinehart
*Attorney, Agent, or Firm*—Freilich, Hornbaker, Rosen & Fernandez

[57] ABSTRACT

An offshore fluid transfer system is described for transferring fluid between an underwater pipe and a dynamically positioned vessel at the sea surface, which is relatively lightweight and economical. The system includes a riser having an upper end attached to the vessel and a lower end having a chain table held by chains extending in catenary curves to the sea floor and weighted by a weight hanging by the chain table. The riser supplied substantially the only mooring force most of the time, while thruster equipment on the vessel supplies sufficient additional force a small amount of the time to limit vessel drift in violent storms. The upper several meters of the riser is a rigid pipe, and an instrument that measures tilt of the pipe indicates the amount and direction of drift of the vessel.

6 Claims, 3 Drawing Sheets

LIGHTWEIGHT TRANSFER REFERENCING AND MOORING SYSTEM

BACKGROUND OF THE INVENTION

One type of prior offshore system for transferring hydrocarbons between an underwater pipe and a vessel uses a heavY duty riser to moor the vessel to limit drift while oil is transferred through a separate conduit. U.S. Pat. No. 3,979,785 by Flory shows one system of the this type, wherein the riser is a heavy duty chain whose lower end is anchored by a chain table held by catenary chains and whose upper end is held by a buoy which moors a ship. In that system a separate flexible hose extends from near the bottom of the riser along a separate path to the ship. Another approach shown in U.S. Pat. No. 4,490,121 by Coppens shows a heavy duty riser in the form of a large diameter pipe or body with its upper end supported by the bow of a vessel and its lower end anchored by catenary chains, to apply large forces that moor a large tanker. Fluid is carried by hoses that extend through the hollow body, with the hollow body carrying substantially all tension passed along the riser. These systems are heavy and costly because they must hold a large ship in position.

Lower cost fluid transfer mooring terminals can sometimes be constructed by using a dYnamically positioned vessel which is connected through a neutrally buoyant hose to a pipe at the sea floor. The DP vessel (dynamically positioned vessel) may use a wire line reference system (a wire extending from the sea floor to the ship, whose angle indicates drift) to monitor vessel drift so a propulsion system on the vessel can move it to avoid excessive drift that would harm the hose. However, the position of the flexible hose is largely uncontrolled, so it may become damaged and there would be interference between the wire line and hose. Such interference is also likely if the vessel is allowed to revolve in a weathervaning mode to reduce propulsion power. A fluid transfer system for use with a dynamically positioned vessel, which enabled control of hose position in a low-cost transfer system, and which facilitated measurement of vessel drift without the need for a separate wire line, would be of considerable value.

The thruster equipment of a DP vessel has a limited lifetime of use (before overhaul is required), with the lifetime dependent on the period during which it is operated at more than verY low power (used to lubricate the bearings). This is a disadvantage in production from an undersea well, as production systems are generally costly to disconnect from and reconnect to. A production system which avoided the limited lifetime of often-used thruster equipment while avoiding the cost of a heavy passive mooring system, would be of considerable value.

SUMMARY OF THE INVENTION

In accordance with one embodiment of the present invention, an offshore fluid transfer system is provided for transferring fluid through a conduit between an underwater pipe and a dynamically positioned vessel, which enables the simple determination of vessel drift, and which enables the system to be constructed at moderate cost. The system can comprise a mooring system which has sufficient strength to moor the vessel under calm to somewhat turbulent seas, but insufficient strength to moor the vessel in stormy seas. In stormy seas the propulsion system of the dynamically positioned vessel serves to limit vessel drift. The lifetime of maintenance-free use of the propulsion system is greatly extended by the fact that it operates only once in a while at moderate to high power levels.

The system can include a riser having an upper end pivotably attached to the dynamically positioned vessel and a lower end with a chain table held by catenary chains extending to the sea floor. The lower portion of the riser is weighted, and substantially all of the weight is supported by tension in the riser, which maintains the riser largely straight. A lightweight riser can be formed by one or a few conduits, which may be a flexible hose, extending most of the length of the riser, with the conduit maintained substantially straight by carrying the moderate tension of the riser.

Drift of the vessel can be determined by measuring tilting of the upper end of the riser. The pivotal mounting of the riser upper end to the vessel may be through a universal joint, and pivoting of parts of the universal joint can indicate tilting of the upper portion of the riser. Where most of the riser length is taken up by a flexible hose, the top of the riser may include a rigid pipe extending a plurality of meters, so tilt of the rigid pipe mcre closely represents average tilt of the entire riser.

The novel features of the invention are set forth with particularity in the appended claims. The invention will be best understood from the following description when read in conjunction with the accompanying drawings.

DESCRIPTION OF THE PREFERRED EMBODIMENTS

Figure 2:
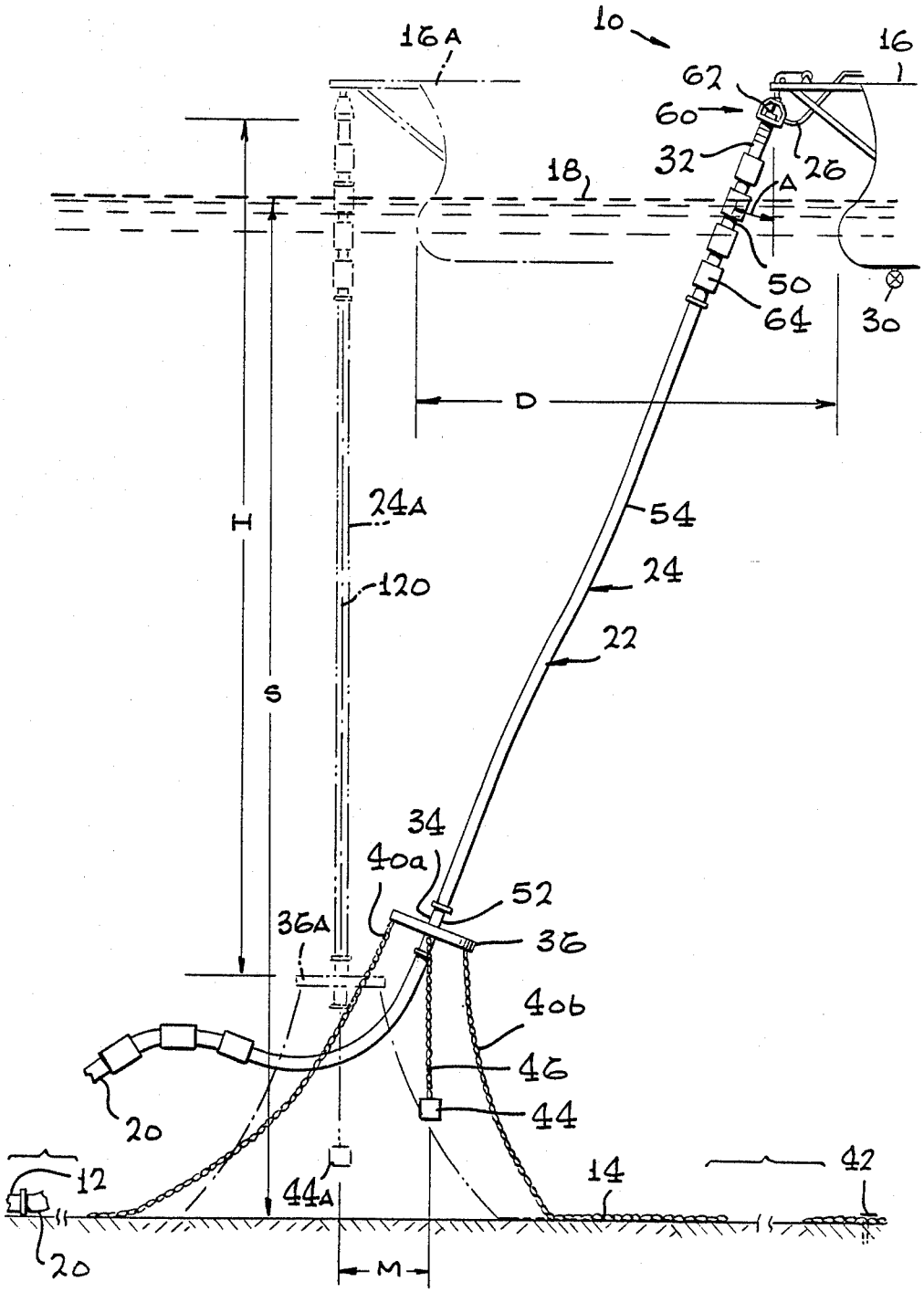
FIG. 2 is a view similar to that of FIG. 1, but showing the riser connected to the vessel, and showing the system at positions of large and of substantially zero drift.

FIG. 2 illustrates an offshore fluid transfer terminal or system 10 for transferring fluid between an underwater pipe 12 lying near the sea floor 14 and a dynamically positioned vessel 16 at the sea surface 18. Fluid passes from the pipeline through a lower conduit 20 and through a riser conduit 22 of a riser 24, through a swivel 62, and through a hose 26 to the vessel.

So long as the vessel is connected through the conduits, it is important that the vessel not drift too far from a quiescent position, indicated at 16A wherein the riser at 24A is substantially vertical, or else the conduits will be damaged. While it is possible to transmit large mooring forces through a riser, this requires a heavy duty riser for withstanding the large mooring forces of a tanker, which results in an expensive underwater system. In many applications, it is preferable to use a low-cost underwater installation just to transfer fluid, and to use a propulsion system such as at 30 on the vessel which allows the vessel to propel itself so as to avoid excessive drift. So long as the terminal does not have to transmit mooring forces, it would be possible to transfer fluid by a simple flexible hose extending between the sea floor pipe and vessel. However, the position of such a hose is difficult to control, not only during fluid transfer, but also when the system is disconnected from the vessel. The disconnected hose may be run over by a ship and damaged, while a connected hose may become damaged by contact by a wire line reference system that can be used to determine drift of the vessel.

The present system 10 controls the position and orientation of most of the riser conduit 22, or at least the portion which extends at or under the water surface to a depth of half the sea height, by the incorporation of that conduit portion in the riser 24. The riser 24 includes an upper end 32 detachably attachable to the vessel, and a lower end 34 with a chain table 36. The chain table is urged towards a quiescent position 36A by a group of chain devices such as **40*a*, 40*b*, and others, which extend in different directions from the chain table to the sea floor, and which are anchored as at 42 to the sea floor. In addition, a deadweight 44 is provided which hangs under the chain table, as by another chain device 46. The weight of the chains and of the deadweight 44 make the lower end of the riser 24** negatively buoyant, with the weight transferred through the riser and supported by the vessel.

The riser 24 includes a rigid pipe 50 at its upper end, another rigid pipe 52 at its lower end, and a flexible middle conduit portion 54 extending along most of the height H of the riser. The flexible middle conduit portion 54 is maintained in substantially a straight line, because it is maintained under tension due to its supporting the negative buoyancy of the chain table and the deadweight 44 and the chains hanging therefrom. A rigid middle conduit portion can be used in place of hose 54, which does not have to have large structural strength because it is constantly maintained in low to moderate tension. However, a flexible middle conduit portion is generally preferred, because it can bend under sideward loading by currents and the like to avoid damage, and yet still extends in substantially a straight line because of the tension transmitted through it. The deadweight44 hung from the chain table is made only large enough to supply sufficient tension in the middle conduit portion to assure its stability. The chains such as **40*a*, 40*b*, the weight 44, and the chain table 36** can all be of relatively light weight, because they do not transmit large forces that would be necessary to moor a tanker, but only keep the riser in tension.

Figure 1:
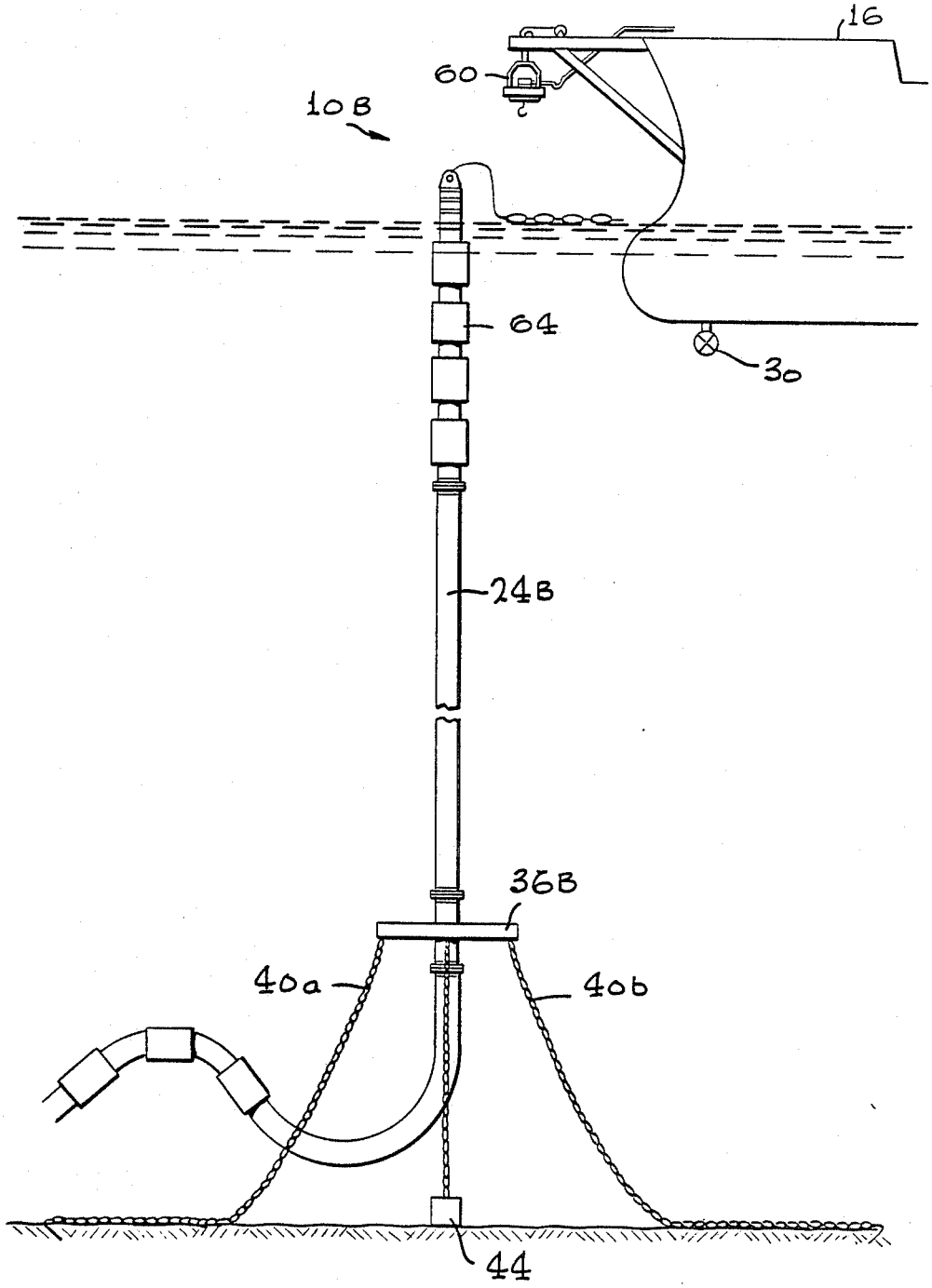
FIG. 1 is a side elevation view of an offshore fluid transfer system constructed in accordance with the present invention, with the riser shown disconnected from the vessel.

The top of the riser is held in a lock (not shown) that rigidly attaches it to the lower part of a universal joint 60. Fluid from the top of the riser can pass through a fluid swivel 62 and through the hose 26 to the vessel. In a simple fluid transfer system where fluid is transferred from storage to a tanker (as compared to a production system where fluid is produced 0 from undersea wells and initially flows to the vessel), the top of the riser can be readily connected and later disconnected from the universal joint 60 on the vessel to allow the vessel to sail away after it has been filled with hydrocarbons. FIG. 1 illustrates the position of the fluid transfer system at 10B after the riser has been disconnected. The top of the riser includes floats 64 which have sufficient buoyancy to support the weight of the riser 24B (FIG. 1) and chain table 36B and the weight of the chains such as **40*a* and 40*b* which lie above the sea floor. However, the buoyancy is not sufficient to support the deadweight 44, and therefore the riser sinks to a depth at which the deadweight 44** rests on (or even slightly below) the sea floor.

Figure 3:
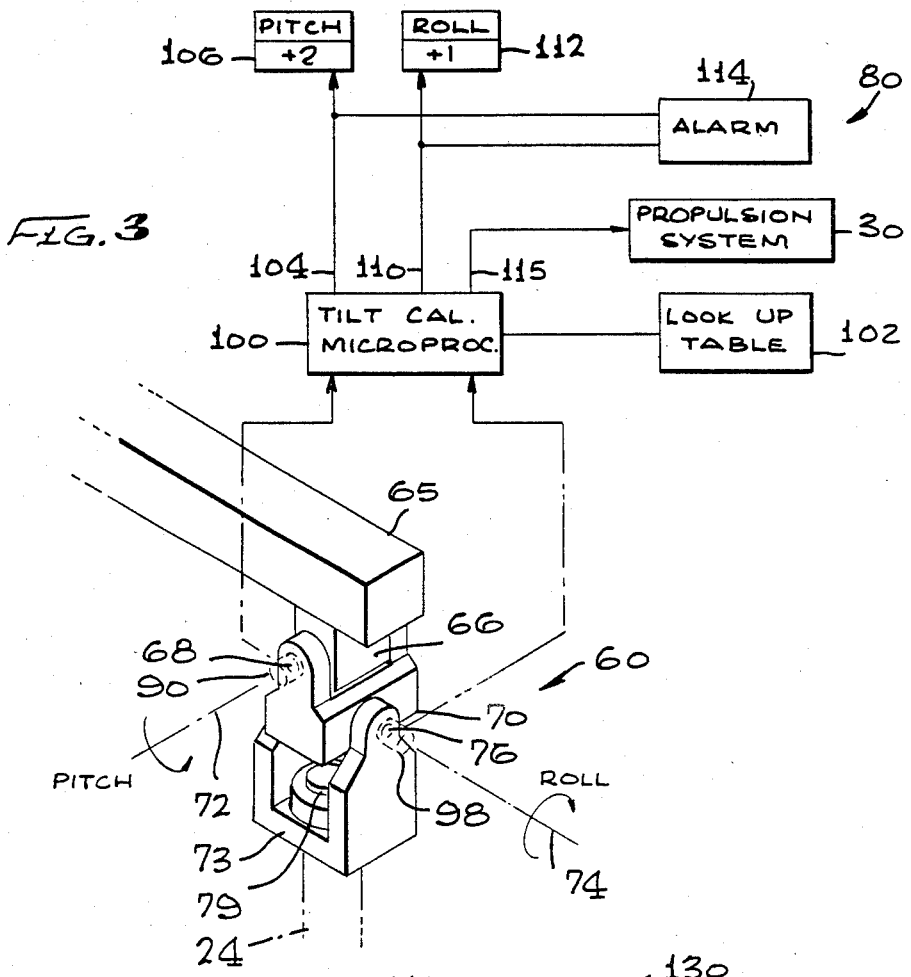
FIG. 3 is a partial perspective view of a tilt measuring device of the system of FIG. 1.

FIG. 3 illustrates some details of the universal joint 60 through which the top of the riser 24 is coupled to a mount 65 on the vessel. The universal joint includes an upper part 66 forming an axle 68, a middle part 70 which can pivot about a pitch axis 72 about the axle 68 of the upper part, and a lower part 73 which can pivot about a roll axis 74 on an axle 76 of the middle part. Thus, the lower part 73 of the joint can pivot about two perpendicular substantially horizontal axes 72, 74. The riser 24 is fixed to the lower joint part.

The amount and direction of tilt of the riser 24 indicates the amount and direction of drift of the vessel from its quiescent position at 16A (FIG. 2). FIG. 3 illustrates a drift indicating system or mechanism 80 which enables personnel on the vessel to determine drift of the vessel from its quiescent postion, by sensing tilt of the riser 24. The amount of vessel drift D (FIG. 2) is approximately equal to the sine of tilt angle A of the riser as measured at the upper pipe 50, times the height H of the riser, plus horizontal motion M of the bottom of the riser. In addition, there is some bending of the flexible middle portion 54 of the riser which can be taken into account. For a given system, it is possible to develop a correlation between the tilt angle A of the upper pipe of the riser and the distance D of drift of the vessel and the top of the riser. The flexible middle portion 54 of the riser bends only a small amount because of the fact that it is under tension, and because a relatively thin chain such as **40*a* which tends to tilt the chain table and bottom of the riser has only a small weight (and there is a small difference in weight between the supported portions of the opposite chains 40*a*, 40*b*). The fact that the upper portion of the riser comprises a hard pipe results in minimizing tilt in the top of the riser due to waves and like. Although it is possible to determine actual vessel drift from its quiescent position, it is often sufficient to determine only tilt, or to determine when the riser has tilted so far from the vertical that there is danger of damaging the terminal in the event of further vessel drift. For a system of the type shown in FIG. 2**, there is a danger of damage at a tilt angle A of about 40°. The maximum allowable tilt angle can be set at about 30°, at which time disconnection may be called for if the vessel propulsion system cannot avoid further drift.

In FIG. 3, tilt of the riser 24, which is rigidly clamped by a connector 79 to the lower joint part 73 of the universal joint, can be determined by sensing tilt of parts of the joint. Tilt of the riser and joint in pitch, about axis 72, is determined by rotation of a position sensor 90 coupled to the axle 68 and middle joint part 70 to sense rotation of the middle joint part about the pitch axis.

Pivoting of the riser about a perpendicular roll axis 74 is measured by another rotation sensor 98 which senses rotation of the lower joint part 73 relative to the second axle 76. Of course, rotation sensed by the sensor 98 is affected not only by pivoting about the roll axis 74, but also about the perpendicular pitch axis 72. The outputs of the sensors 90, 98 are delivered to a tilt calculating microprocessor 100. In one system, the microprocessor is coupled to a lookup table 102 which provides an indication of tilt of the riser 24 ad/or drift of the vessel at any given combination of outputs of the sensors 90, 98. The microprocessor 100 has outputs 104, 110 delivered to indicators 106, 112 which respectively indicate the angle of tilt in pitch and roll of the upper end of the riser 24. The signals on lines 104, 110 represent vessel drift as well as riser tilt, since there is a close correlation between them. It is possible to have a seaman view the indicators 106, 112 and operate the dynamic positioning equipment on the vessel to counter drift of the vessel as indicated by tilt of the riser, as by turning on the propulsion system when tilt in any direction exceeds 70°. An alarm 114 sounds when tilt in any direction reaches 30°. However, it is generally desirable to have the output of the microprocessor 100 directly control the dynamic positioning propulsion system of the vessel, since control by a seaman can be difficult in stormy weather. An output 115 is shown extending directly from the microprocessor to the propulsion system 30 to control the amount and direction of thrust.

In one system designed for use in a sea of a depth S (FIG. 2) of 600 feet, the riser 24 had a height H of about 500 feet, with the upper pipe 50 of the riser having a length of about 100 feet, and the lower pipe 52 having a length of about 50 feet. The upper pipe 50 extends a plurality of feet underwater for all vessels connectable to it. The deadweight 44, which provides weight at low cost, had a weight of about 50 tons. The chains 40*a* had a weight per foot of about 15 pounds. Since the riser is not intended to supply substantial mooring forces to a vessel, the terminal was usable with dynamically positioned tankers of a variety of sizes. A system similar to this, but capable of mooring a tanker, might have chains of a weight of about 65 pounds per foot and a deadweight of 200 tons, or in other words, be about four to five times as heavy.

One approach to terminal design is to construct a terminal strong and heavy enough to moor a tanker without a dynamic positioning thruster. A different approach is to construct a terminal which is of light weight and of low-cost and which supplies very little mooring force, while a dynamic positioning thruster on the vessel supplies substantially all mooring forces. It can be advantageous to provide a design halfway between these extremes. That is, it can be highly advantageous to provide a moderate strength terminal which supplies moderate mooring forces that are sufficient almost all of the time, together with a dynamically positioned vessel whose thruster supplies the thrust required once in a while. A system where the ship thruster equipment supplies substantially all mooring forces, so rt operates most of the time at moderate to high thrust levels (i.e., over 5% of maximum thrust which the thruster can apply), is expected to last no more than about three years between times required for overhaul. On the other hand, a thruster which is seldom used at more than low levels (to keep the bearings lubricated) is expected to last about ten years between required overhaul times. Where the terminal is used to produce oil from undersea wells, the cost of disconnection and downtime is large, and it is desirable to reduce the possibility and occurence of such downtime. While thruster downtime is avoided by using a heavy-duty mooring system that does not require a dynamically positioned vessel, the cost of manufacturing and installing such a terminal is high.

A fluid transfer system, especially for the production of hydrocarbons from undersea wells, can be economically constructed and maintained by the use of a terminal of moderate mooring capability, to provide moderate passive mooring forces, combined with a dynamic positioning thruster on a vessel which is used only once in a while.

Figure 4:
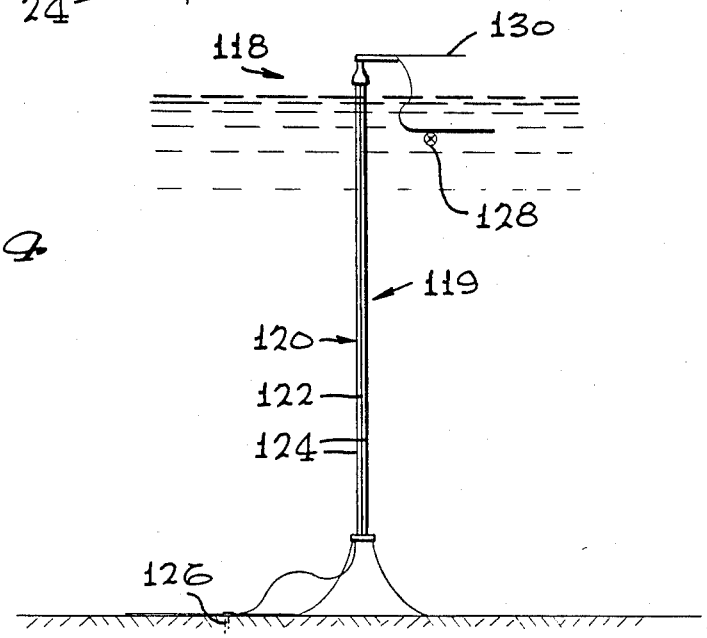
FIG. 4 is a side elevation view of an offshore system constructed in accordance with another embodiment of the invention.

For example, the system of FIG. 2 can be constructed with a weight of chains such as 40*a*, 40*b* of 35 pounds per foot, a deadweight 44 of 100 tons, and a riser 24 which includes a chain that withstands the load, and with conduits lying around the chain and not under large tension. Such a system may be used in an environment where it provides sufficient strength to moor the vessel except in storms of an intensity that have been found to occur on an average of only once a year in that location. The terminal will not be overloaded for up to a tilt of 30° from the vertical. FIG. 4 illustrates a system 118 of this type which includes a passive mooring terminal 119 for mooring a vessel 130. The terminal includes a riser 120 having a central chain 122 and conduits 124 around the chain. The conduits are coupled to an undersea well 126. Thruster equipment 128 on the moored vessel 130 is only rarely used.

As a result, the vessel thruster is not operated to produce significant thrust (over 5% of its maximum) except during about three days per year when a storm of a once-a-year strength occurs, and the terminal provides sufficient mooring 99% of the time. The weather history of the region where the terminal is installed will be known. The drift indicating system of FIG. 3 can be constructed so that the alarm 114 sounds only when the riser tilt reaches 30°, and at that time the propulsion system 30 is activated to limit riser tilt and therefore vessel drift. Where the terminal strength is relied on, it should be sufficient to supply the required mooring force at least 90% of the time for that particular location and vessel, while the dynamic positioning mechanism on the vessel provides sufficient force for substantially the rest of the time. Only in a very severe storm, such as of an intensity which occurs only once in perhaps 20 years in that location, would the vessel be disconnected from the riser because its thrusters cannot hold the vessel position. The thruster equipment on the vessel supplies sufficient thrust to limit vessel drift (in combination with the terminal) at least about 99% of the time.

Thus, the invention provides an offshore fluid transfer system for transferring fluid through conduits between an underwater pipe and a dynamically positioned vessel, in a relatively low-cost system. The conduit or conduits which extends up to the vessel can be maintained in tension by forming most of it as a riser extending most of the distance from the sea floor to the sea surface, and is maintained in tension by weighting its lower end. The lower end is able to move vertically and horizontally by a limited amount by holding it with catenary chain devices. Most of the conduit of the riser can be in the form of a flexible conduit, which is maintained relatively straight by the tension in it. An indication of the direction and amount to propel the vessel to avoid excessive drift can be determined by measuring tilt of the upper portion of the riser. This can be accomplished by measuring tilt of a universal joint which couples the upper end of the riser to the vessel. The system can include a terminal formed of the riser, chain table, and anchor chains, which can supply sufficient mooring force to safely hold the vessel most of the time and preferably over 90% of the time. The vessel then has a dynamic positioning thruster which operates less than 10% of the time, to provide a long lifetime of use.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore fluid transfer system for trasnferring fluid between an underwater pipe near the sea floor and a dyanmically positioned vessel at the sea surface, comprising:

a riser having an upper end detachably attachable to said vessel and a lower end having a chain table;

a plurality of chain devices extending in catenary curves in different directions from said chain table to the sea floor and anchored to the sea floor;

said riser having a buoyant upper portion and a weighted lower portion and comprises a lower rigid pipe extending up from said chain table, an upper rigid pipe extending down from said upper riser portion, and a flexible middle conduit portion which is more flexible per unit length than either of aid rigid pipes extending along most of the length of the riser between said upper and lower pipes and supporting in tension said weighted lower portion on said buoyant upper portion;

means coupling said flexible conduit to said underwater pipe.

2. The system described in claim 1 wherein;

said riser has a height of more than half the depth of the sea thereat.

3. The system described in claim 1 including:

a vessel, said vessel includes a pivot joint coupled to the top of said riser and allowing the riser to tilt about two horizontal axes relative to the vssel, and said upper rigid pipe has a length great enough to extend from said joint to the sea surface and a plurality of meters below the sea surface;

said vessel includes propulsion means that allows it to position itself to counter drift; and drift indicating means comprising means responsive to tilt of said upper rigid pipe away from the vertical, for indicating drift of the vessel.

4. An offshore fluid transfer system for transferring fluid between a pipe lying near the sea floor and a dynamically positioned vessel, comprising:

a dynamically positioned vessel which includes a thruster;

a riser extending along most of the height of the sea, and having upper and lower ends, said riser including a fluid conduit for coupling said pipe near the sea floor and said vessel;

means for pivotably coupling said upper riser end to said vessel to allow relative pivoting of the riser upper end to the vessel about two horizontal axes;

means coupling the lower riser end to the sea floor, for allowing the lower riser end to pivot about horizontal axes and move by limited amounts both horizontally and vertically, and for weighting the bottom of said riser to keep it under tension;

means responsive to tilting of said riser upper end from the vertical, and a known relationship between such tilting and drift which takes into account movement of the lower end of the riser, for controlling said thruster.

5. An offshore fluid transfer system for transferring fluid between a pipe lying near the sea floor and a dynamically positioned vessel, comprising:

a riser extending along most of the height of the sea, and having upper and lower ends, said riser including a fluid conduit for coupling said pipe and said vessel;

means for pivotally coupling said upper riser end to said vessel to allow relative pivoting of the riser upper end to the vessel about two horizontal axes;

means coupling the lower riser end to the sea floor, for allowing the lower riser end to pivot about horizontal axes and move by limited amounts both horizontally and vertially, with respect to a quiescent position at which said riser extends substantially vertically at a predetermined location, and for weighting the bottom of said riser to keep it under tension;

means rsponsive to tilting of said riser upper end from the vertical and a known relationship between such tilting and drift which takes into account movement of the lower end of the riser, for generating signals representing the direction and amount of drift of said vessel from said quiescent position.

6. The system described in claim 5 wherein:

said means for pivotably coupling said upper riser end to said vessel includes a universal joint which includes an upper joint part mounted to said vessel, a middle joint part pivotably mounted about a first substantially horizontal axis on said upper joint part, a lower joint part pivotably mounted on said middle joint part about a second axis which is substantially horizontal and perpendicular to said first axis, said upper end of said riser being fixed to said lower joint part so they both pivot together about horizontal axes;

said means responsive to tilting includes means coupled to at least said lower joint part for sensing tilt thereof.

* * * * *